US006405652B1

(12) United States Patent
Hoffmann et al.

(10) Patent No.: US 6,405,652 B1
(45) Date of Patent: Jun. 18, 2002

(54) PROJECTILE FUZE OPERATED BY A STABILIZATION BAND OF THE PROJECTILE

(75) Inventors: Wolfgang Hoffmann, Velbert; Michael Günther, Meerbusch; Tobias Zerbe, Munster, all of (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/551,616

(22) Filed: Apr. 17, 2000

(30) Foreign Application Priority Data

Apr. 15, 1999 (DE) ..... 199 16 775

(51) Int. Cl.[7] ..... F42C 15/18
(52) U.S. Cl. ..... 102/230
(58) Field of Search ..... 102/230, 223, 102/226, 260

(56) References Cited

U.S. PATENT DOCUMENTS

| | | | | | |
|---|---|---|---|---|---|
| 3,913,483 | A | * | 10/1975 | Wolterman | 102/476 |
| 3,926,122 | A | * | 12/1975 | Wolterman | 102/226 |
| 3,956,992 | A | * | 5/1976 | Tari | 102/244 |
| 4,455,940 | A | * | 6/1984 | Furuike | 102/228 |
| H136 | H | * | 10/1986 | Field | 102/487 |
| 4,662,278 | A | * | 5/1987 | Lillios | 102/223 |
| 4,762,066 | A | * | 8/1988 | Rudenauer et al. | 102/226 |
| 4,998,476 | A | * | 3/1991 | Rudenauer et al. | 102/226 |
| 5,048,419 | A | * | 9/1991 | Skowasch | 102/226 |
| 5,142,079 | A | * | 8/1992 | Chiba et al. | 556/183 |
| 5,206,457 | A | | 4/1993 | Pascal et al. | |
| 5,387,257 | A | * | 2/1995 | Tari et al. | 102/226 |
| 5,440,992 | A | * | 8/1995 | Chemiere et al. | 102/246 |
| 5,549,047 | A | * | 8/1996 | Borgni | 102/256 |

FOREIGN PATENT DOCUMENTS

| | | |
|---|---|---|
| DE | 3538787 | 5/1987 |

* cited by examiner

*Primary Examiner*—Charles T. Jordan
*Assistant Examiner*—Jordan Lofdahl
(74) *Attorney, Agent, or Firm*—Venable; Gabor J. Kelemen

(57) ABSTRACT

A projectile includes a stabilizing band mounted on a rear projectile portion and having a folded state and a deployed state and a fuze assembly accommodated in the projectile. The fuze assembly includes a firing pin carrier supported for motion parallel to the longitudinal axis of the projectile; a firing pin secured to the firing pin carrier; a slide supported for motion transversely to the projectile axis and having a safety position and a firing position; and a detonator mounted on the slide. The detonator is out of alignment with the firing pin in the safety position of the slide and is in alignment with the firing pin in the firing position of the slide. A force-transmitting component is attached to the stabilizing band and the slide for moving the slide from the safety position into the firing position by a force generated by a motion of the stabilizing band from its folded state into its deployed state.

11 Claims, 5 Drawing Sheets

PROJECTILE FUZE OPERATED BY A STABILIZATION BAND OF THE PROJECTILE

CROSS REFERENCE TO RELATED APPLICATION

This application claims the priority of German Application No. 199 16 775.3 filed Apr. 15, 1999, which is incorporated herein by reference.

BACKGROUND OF THE INVENTION

This invention relates to a submunition projectile having a deployable stabilizing band mounted on a rearward portion of the projectile.

A submunition projectile (bomblet) of the above-outlined type is described, for example, in U.S. Pat. No. 5,048,419. The projectile described therein includes a fuze having an axially shiftable firing pin carrier and a slide which has a detonator charge and which is shiftable transversely to the projectile axis from a safety position into a firing position. A first firing pin is mounted on the firing pin carrier on its side oriented towards the slide. In the safety state of the projectile the first firing pin projects into a recess and is coupled with a projectile stabilizing band on its side oriented away from the slide. Further, as a backup detonator, the slide carries a pyrotechnic delay charge with a primer for the self-destruction of the bomblet. The primer may be ignited by a second firing pin affixed laterally in the fuze housing.

To ensure that the slide, together with the detonator charge is shifted into the firing position in the known bomblets, the bomblet, after being ejected from the carrier projectile, must rotate about its longitudinal axis so that the centrifugal forces affecting the stabilizing band and the slide result in an unscrewing of the first firing pin from the recess of the slide and cause a displacement of the slide from the safety position into the firing position in which the first firing pin is in alignment with the detonator charge.

It is, among others, a disadvantage of submunition projectiles of the above-outlined type that they cannot be fired from weapon systems in which the submunition projectiles, after their ejection over the target area, do not rotate with a sufficient rpm or do not rotate at all. This occurs, for example, when the bomblets are delivered into the target area by wing-stabilized carrier projectiles, such as rockets.

While it is feasible in non-rotating submunition projectiles to cause a shift of the detonator carrier by means of an armed spring, such a solution, however, is, as a rule, not admissible for safety reasons because in case of a failure of the safety, the first firing pin would automatically shift the detonator carrier into its firing position and thus the self-destructing (backup) charge would be ignited.

SUMMARY OF THE INVENTION

It is an object of the invention to provide an improved projectile of the above-outlined type wherein the slide which carries the detonator charge is shifted from its safety position into its firing position without it being necessary that the projectile rotate after it is ejected over the target area.

This object and others to become apparent as the specification progresses, are accomplished by the invention, according to which, briefly stated, the projectile includes a fuze assembly, a stabilizing band mounted on a rear projectile portion and having a folded state and a deployed state. The fuze assembly includes a firing pin carrier supported for motion parallel to the longitudinal axis of the projectile; a firing pin secured to the firing pin carrier; a slide supported for motion transversely to the projectile axis and having a safety position and a firing position; and a detonator mounted on the slide. The detonator is out of alignment with the firing pin in the safety position of the slide and is in alignment with the firing pin in the firing position of the slide. A force-transmitting component, such as a pull cord is attached to the stabilizing band and the slide for moving the slide from the safety position into the firing position by a force which is produced when the stabilizing band moves from its folded state into its deployed state.

It is an essential principle of the invention to connect the stabilizing band with a component, such as a pull cord which, as the stabilizing band is deployed by the air current, exerts a suitably directed force on the slide to shift it from its safety position into its firing position.

According to a further feature of the invention, the firing pin carrier is attached to the stabilizing band which, upon deployment, pulls the firing pin carrier axially away from the slide to thus pull out the firing pin from a hole which is provided in the slide and into which the firing pin projects when the slide is in the safety position. To ensure that the firing pin can be pulled out of the hole to thus release the slide only when a predetermined axial pulling force is reached, the firing pin carrier is expediently secured in the fuze housing, for example, by a ball safety. Such a ball safety is disposed in the firing pin carrier and includes two balls spaced by a radially disposed compression spring. The balls extend partly into the outer wall region of the firing pin carrier and partly into groove-like recesses of the adjoining edge regions of the igniter housing.

To ensure that an unintended shifting of the detonator carrier cannot take place when it is no longer blocked by the firing pin, in a preferred embodiment of the invention the slide has a securing pin which, in the firing position of the slide, projects through a hole provided in the side wall of the fuze housing. In the safety position of the slide, however, the opening is obturated at its exterior by a cover so that an unintended shifting of the slide into the firing position cannot take place. In carrier projectiles having a series of stacked bomblets arranged behind one another, as a cover for the hole in the fuze housing of a first bomblet preferably the frontal region of an adjoining, trailing second bomblet is used which is positioned in a form-fitting manner about the rearward region of the first bomblet.

DESCRIPTION OF THE PREFERRED EMBODIMENTS

Figure 1:
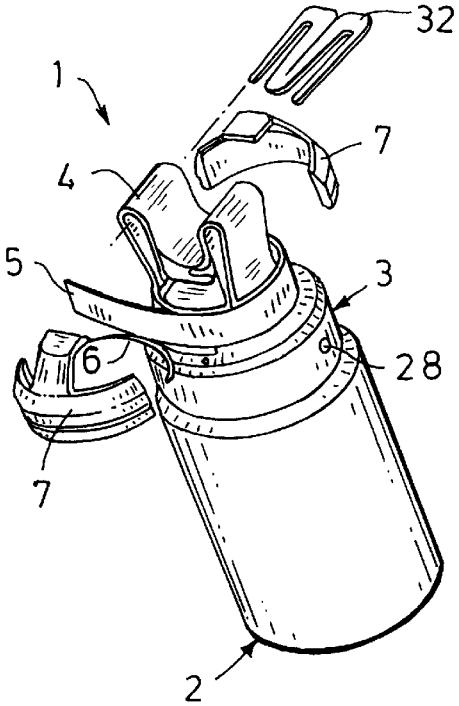
FIG. 1 is a perspective exploded view of a bomblet according to a preferred embodiment of the invention.

FIG. 1 illustrates a bomblet 1 depicted in its condition shortly after being ejected over a target area from, for example, a non-illustrated bomblet carrier rocket. The bomblet 1 includes a projectile body 2 which accommodates, for example, a shaped charge (not shown), a fuze 3 for igniting the shaped charge and a folded stabilizing band 4 mounted in the rear portion of the projectile body 2. The stabilizing band 4 is secured by a wound ribbon 5 held together by a two-part protecting cap 7 surrounded by a resilient securing ring 6.

Figure 2:
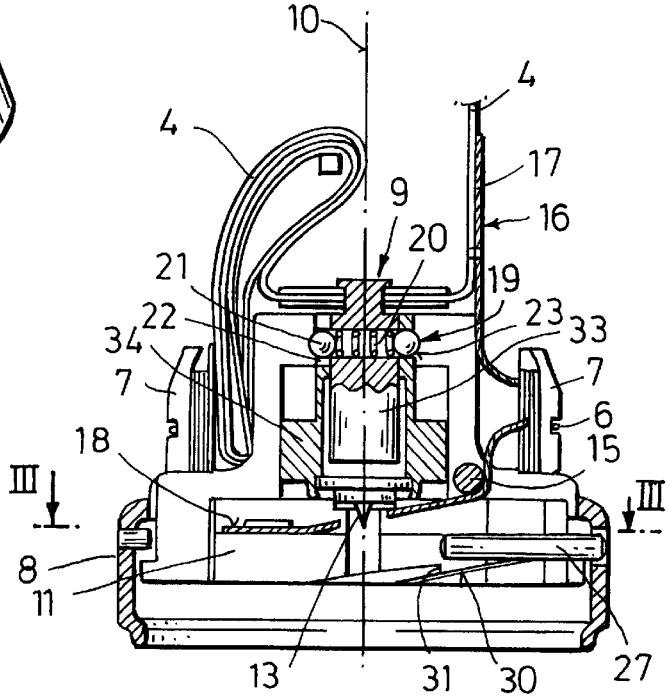
FIG. 2 is an axial sectional view of the rearward terminal region of the bomblet shown in FIG. 1.
Figure 3:
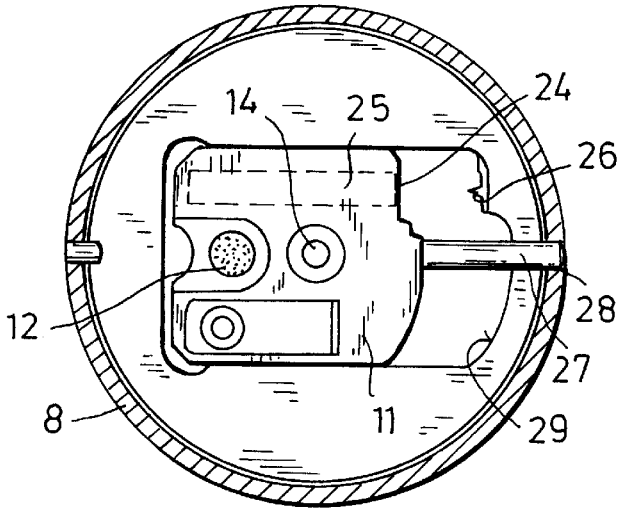
FIG. 3 is a sectional view taken along line III—III of FIG. 2.
Figure 4:
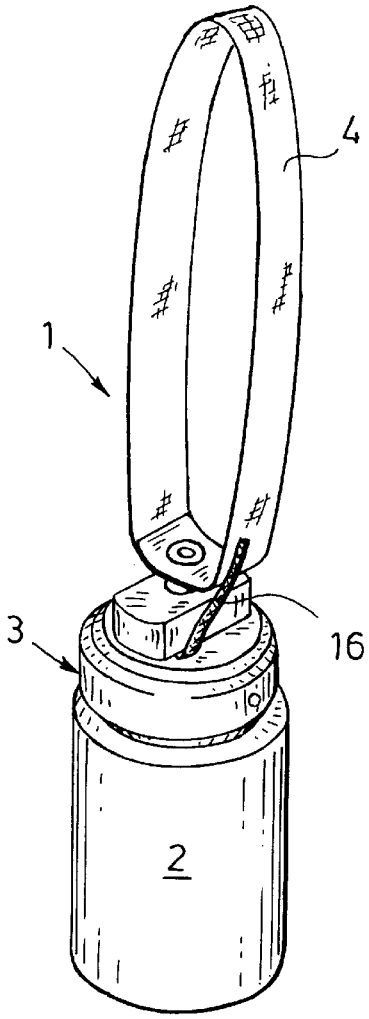
FIG. 4 is a perspective view of the preferred embodiment depicted in a first operational position during deployment of the stabilizing band.
Figure 5:
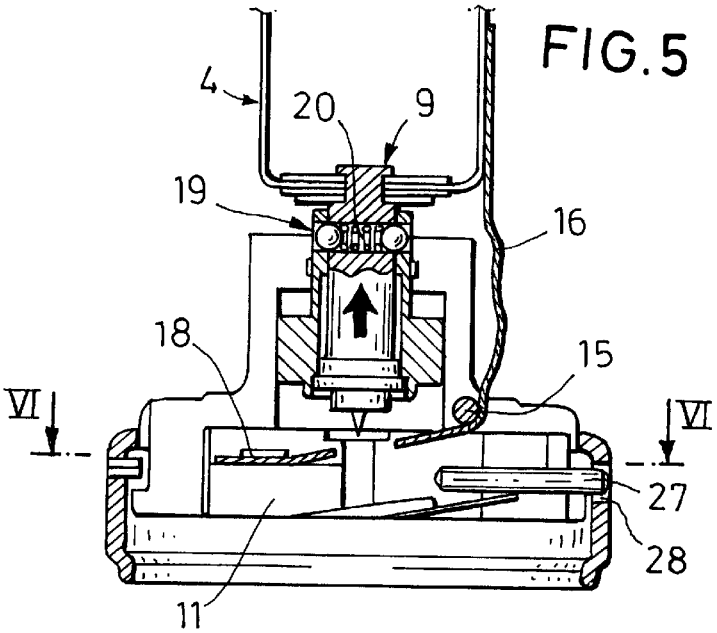
FIG. 5 is an axial sectional view of the rearward terminal region of the bomblet in the first operational position.
Figure 6:
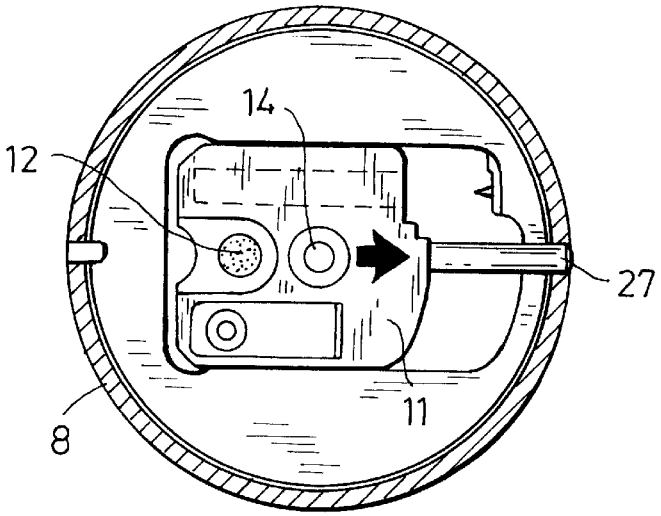
FIG. 6 is a sectional view taken along line VI—VI of FIG. 5.
Figure 7:
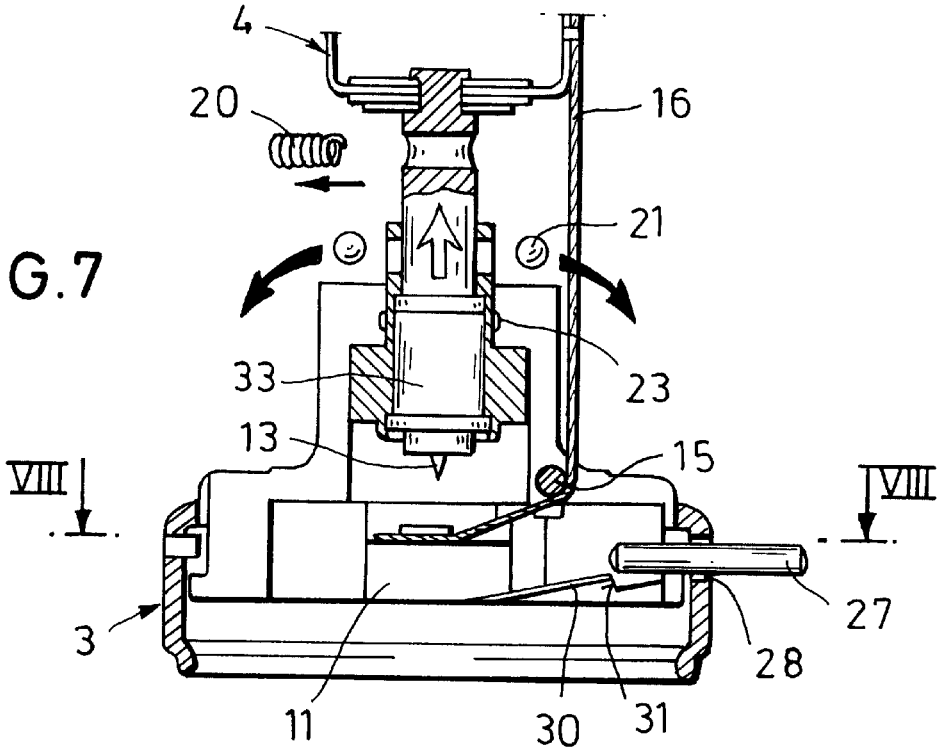
FIG. 7 is an axial sectional view of the rearward terminal region of the bomblet depicted in a second operational position depicted during deployment of the stabilizing band.
Figure 8:
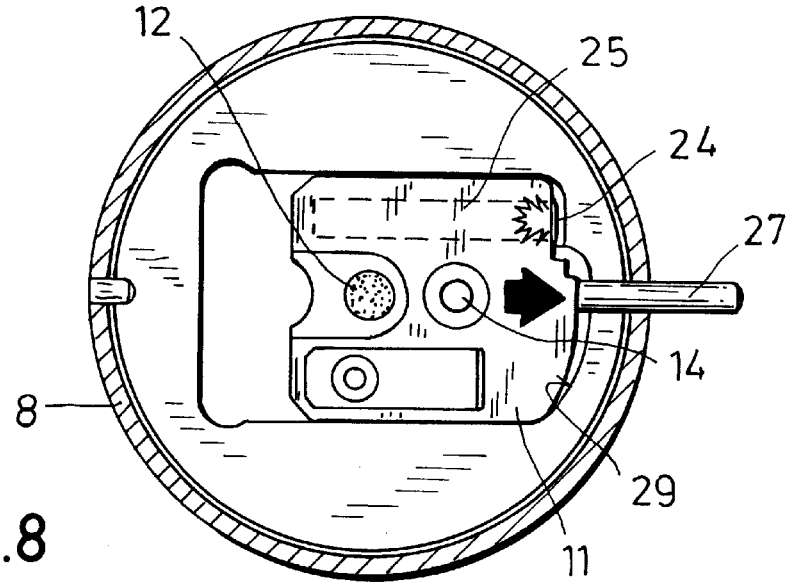
FIG. 8 is a sectional view taken along line VIII—VIII of FIG. 7.

As may be observed in FIGS. 2 and 3, the fuze 3 includes a fuze housing 8 in which an axially displaceable firing pin carrier 9 and a slide 11 which carries a detonator charge 12 and which may be shifted transversely to the longitudinal projectile axis 10 from a safety position into an igniting position. On that side of the firing pin carrier 9 which is oriented towards the slide 11 a first firing pin 13 is mounted which, when the bomblet is in its safety state, is out of alignment with the detonator charge 12 and projects into a hole 14 of the slide 11. A stabilizing band 4 is mounted on that side of the firing pin carrier 9 which is oriented away from the slide 11.

According to the invention the slide 11 and the stabilizing band 4 are connected with a pull cord 16 trained about a deflecting pin 15. A first end 17 of the pull cord 16 is affixed to the stabilizing band 4, while a second end 18 of the pull cord 16 is fixedly riveted to the slide 11.

The firing pin carrier 9 is secured by a ball safety 19 from dropping out rearwardly from the fuze housing 8. The ball safety is composed of two balls 21 which are spaced from one another by a radially arranged compression spring 20 and which are arranged in the firing pin carrier 9. The balls project in part into the outer wall region 22 of the firing pin carrier 9 and in part into groove-like recesses 23 of the adjoining wall regions of the fuze housing 8.

The slide 11 accommodates a pyrotechnic delay charge 25 having a primer 24 which may be ignited by a second firing pin 26 mounted laterally in the fuze housing 8. The purpose of the second firing pin 26 is to initiate a self-destruction of the bomblet 1 in case the shaped charge is not activated by the first firing pin (for example, because of a soft impacting of the bomblet on the target).

Further, on the side of the slide 11 a bar-shaped safety component (securing pin) 27 is mounted which projects through an opening 28 of the lateral wall 29 of the fuze housing 8 when the slide 11 is in the firing position. The opening 28 is, when the bomblet 1 is still situated in the carrier projectile, obturated by the frontal region of the rearwardly adjoining bomblet so that the slide 11 may not shift radially into the firing position.

The slide 11 may be locked by a spring tongue 30 mounted in the fuze housing 8 when the slide 11 is in its firing position and is supported in such a position on a projection 31 of the slide 11.

In the description which follows the operation of the above-described bomblet will be set forth in conjunction with FIGS. 1–10.

After ejection of the bomblet 1 from a carrier projectile the individual bomblets are separated from one another (FIG. 1), so that the opening 28 in the side wall of the fuze housing 8 of the respective bomblet 1 is no longer blocked. At the same time, the stabilizing band 4 is deployed from its folded position by the force of the air current. During this occurrence the plastic clamps 32 (FIG. 1), the resilient securing ring 6 and the two-part protecting cap 7 fly off the fuze housing 8 and release the wound ribbon 5 which unwinds and is thereafter ejected.

Upon deployment of the stabilizing band 4 (FIG. 4), by virtue of its direct connection with the firing pin carrier 9, pulls the latter rearward against the pressure of the spring 20 of the ball safety 19 (FIG. 5) and thus the first firing pin 13 is pulled out of the hole 14 of the slide 11. Thereafter the stabilizing band 4, moved rearward by the air current, radially shifts the slide 11 via the pull cord 16 until the slide 11 abuts the side wall 29 of the fuze housing 8 (FIGS. 7 and 8) to thus assume its firing position in which the spring tongue 30 immobilizes the slide 11. At this time the detonator charge 12 of the bomblet 1 is situated in axial alignment with the first firing pin 13 and the second firing pin 26 has activated the primer 24 of the delay charge 25.

Figure 9:
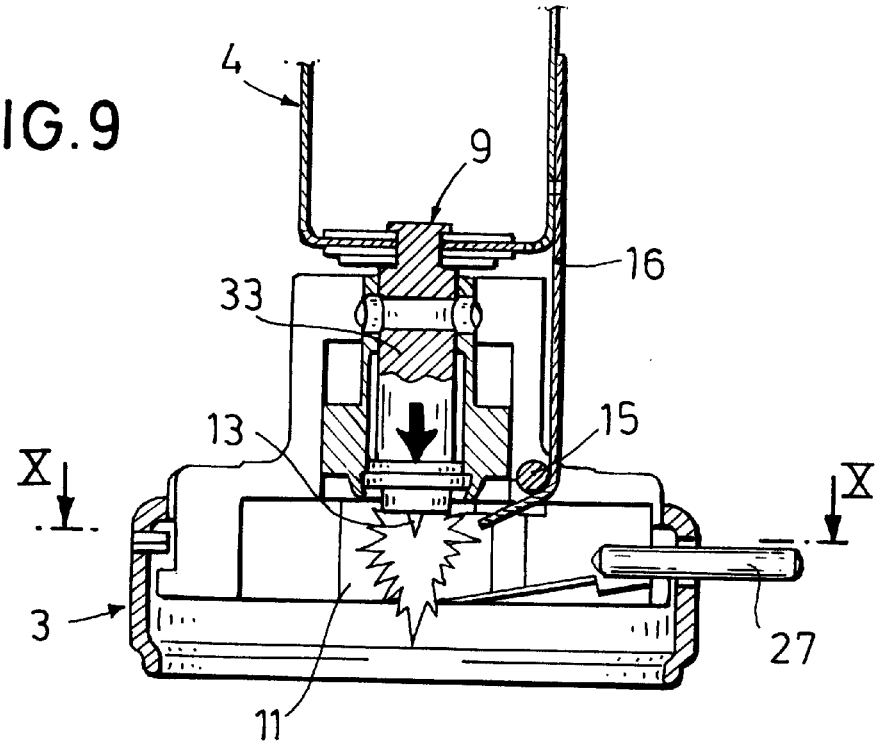
FIG. 9 is an axial sectional view of the rearward terminal region of the bomblet depicted in a third (target-hitting) operational position.

During a subsequent hard impact of the projectile the first firing pin 13 strikes the detonator charge 12 which ignites the shaped charge via a non-illustrated booster charge (FIG. 9).

Figure 10:
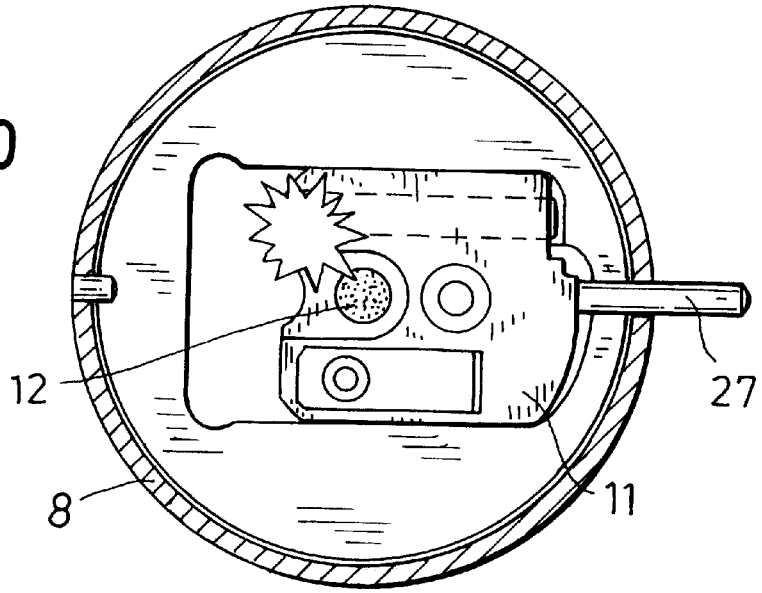
FIG. 10 is a sectional view taken along line X—X of FIG. 9.

In case the detonator charge 12 is not activated by the first firing pin 13 within a predetermined period (for example, because the bomblet 1 impacted on a very soft substance), the shaped charge is ignited by the ignition delay charge 25 (FIG. 10).

It is to be understood that the invention is not limited to the specifically described embodiment. Thus, for example, the firing pin carrier 9, as shown in FIGS. 2, 5, 7 and 10, may be of a multi-part construction wherein a piston 33 connected with the first firing pin 13 is shiftably disposed in a sleeve 34 accommodating the balls 21 of the ball safety 19.

Further, the term "stabilizing band" within the meaning of the invention is intended to mean not only the loop-shaped bands shown in the Figures but also, in the broad sense, any parachute-like structure which is opened by the forces derived from the air streams and activates a pull cord (or pull band) for shifting the detonator carrying slide.

Figure 11:
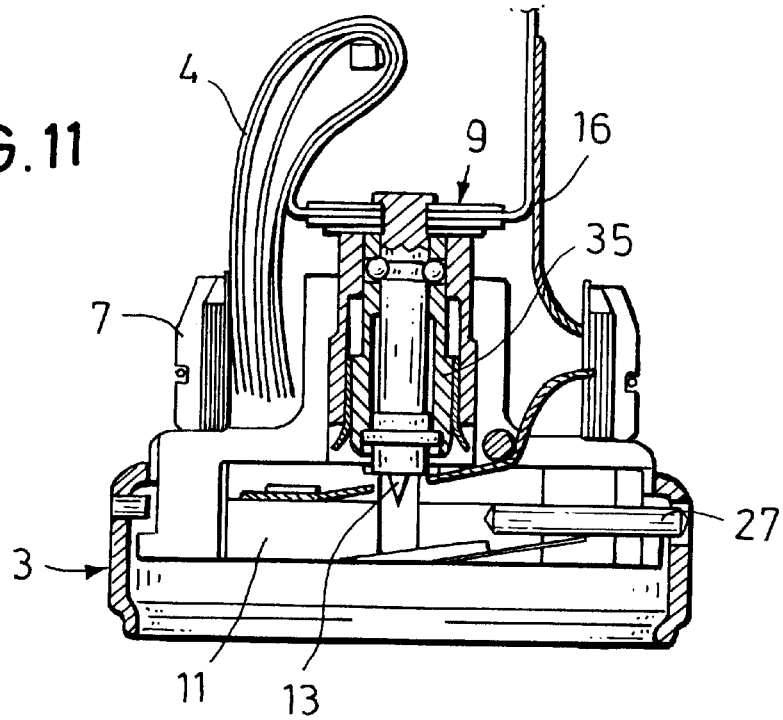
FIGS. 11 and 12 are axial sectional views of the rearward terminal region of the bomblet depicted according to two further preferred embodiments of the invention.
Figure 12:
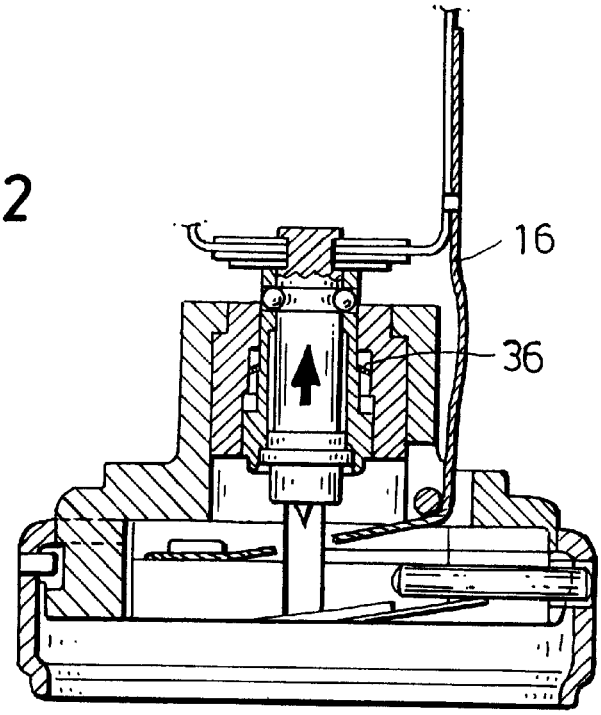

Further, for increasing the resistance of the firing pin carrier 9 against being pulled out, instead of a ball safety (or in addition thereto) spring elements between the firing pin carrier 9 and the fuze housing 8 may be arranged. Such embodiments are shown in FIGS. 11 and 12 wherein in FIG. 11 spring pins 35 and in FIG. 12 a spring disk 36 are provided.

It will be understood that the above description of the present invention is susceptible to various modifications, changes and adaptations, and the same are intended to be comprehended within the meaning and range of equivalents of the appended claims.

What is claimed is:

1. A projectile having a longitudinal axis and a rear portion; said projectile comprising a stabilizing band mounted on said rear portion and having a folded state and a deployed state and a fuze assembly accommodated in said projectile; said fuze assembly comprising (a) a firing pin carrier supported for motion parallel to said longitudinal axis;

(b) a firing pin secured to said firing pin carrier;

(c) a slide supported for motion transversely to said longitudinal axis; said slide having a safety position and a firing position;

(d) a detonator mounted on said slide; said detonator being out of alignment with said firing pin in said safety position of said slide and being in alignment with said firing pin in said firing position of said slide; and (e) force transmitting means for transmitting a force, generated by a motion of said stabilizing band from said folded state into said deployed state, to said slide for moving said slide, by said force, from said safety position into said firing position.

2. The projectile as defined in claim 1, wherein said force transmitting component is a pull cord.

3. The projectile as defined in claim 2, further comprising a deflecting member about which said pull cord is trained for exerting a pulling force on said slide transversely to said longitudinal axis.

4. The projectile as defined in claim 1, further comprising (f) a hole provided in said slide and being in alignment with said firing pin in said safety position of said slide; said firing pin projecting into said hole in said safety position of said slide; and (g) connecting means for coupling said stabilizing band to said firing pin carrier for axially rearward displacing said firing pin carrier by said stabilizing band upon movement thereof from said folded state into said deployed state.

5. The projectile as defined in claim 1, further comprising (f) a delay charge mounted on said slide; and (g) an additional firing pin held stationarily in alignment with said delay charge for striking and igniting said delay charge upon movement of said slide from said safety position into said firing position.

6. The projectile as defined in claim 1, further comprising (f) a fuze housing accommodating said firing pin carrier and provided with recesses; and (g) a ball safety for preventing said firing pin carrier from sliding out of said housing in a direction away from said slide; said ball safety including (1) two balls disposed in said firing pin carrier and partially projecting therefrom into said recesses in a direction transverse to said longitudinal axis; and (2) a spring disposed between said balls and urging said balls away from one another.

7. The projectile as defined in claim 1, further comprising (f) a fuze housing accommodating said firing pin carrier; and (g) an axially oriented spring element situated between said firing pin carrier and said housing for preventing said firing pin carrier from sliding out of said housing in a direction away from said slide.

8. The projectile as defined in claim 1, further comprising (f) a fuze housing accommodating said slide and having a throughgoing hole;

(g) a securing pin affixed to said slide and projecting therefrom transversely to said longitudinal axis and in alignment with said hole; said securing pin projecting through said hole in said firing position of said slide; and (h) means for covering said hole for preventing said securing pin from projecting therethrough to prevent said slide from moving from said safety position into said firing position.

9. The projectile as defined in claim 8, wherein said projectile is a first projectile, in combination with a second projectile adjoining said first projectile; said second projectile having a wall portion covering said hole in said fuze housing of said first projectile; said wall portion of said second projectile constituting said means for covering said hole.

10. The projectile as defined in claim 1, further comprising (f) a fuze housing accommodating said slide;

(g) a spring tongue supported in said fuze housing; and (h) a projection forming part of said slide; said spring tongue engaging said projection in said firing position of said slide for locking said slide in said firing position.

11. The projectile as defined in claim 1, wherein said force transmitting means comprises a force transmitting component affixed to said stabilizing band and to said slide.

* * * * *